United States Patent [19]

Bradam

[11] 4,020,328

[45] Apr. 26, 1977

[54] AUXILIARY KEYBOARD APPARATUS

[75] Inventor: William R. Bradam, Cambridge, Ohio

[73] Assignee: NCR Corporation, Dayton, Ohio

[22] Filed: Dec. 16, 1975

[21] Appl. No.: 641,411

[52] U.S. Cl. ..... 235/146

[51] Int. Cl.[2] ..... G06C 7/02

[58] Field of Search ..... 197/98; 235/146

[56] References Cited

UNITED STATES PATENTS

| | | | |
|---|---|---|---|
| 2,535,178 | 12/1950 | Walker | 235/146 |
| 2,635,330 | 1/1953 | Buckey et al. | 235/146 |
| 2,736,497 | 2/1956 | Ellerbeck | 235/146 |

*Primary Examiner*—E. S. Jackmon
*Attorney, Agent, or Firm*—J. T. Cavender; Wilbert Hawk, Jr.; Richard W. Lavin

[57] ABSTRACT

A low cost auxiliary keyboard is disclosed which is mounted on the keyboard of a data terminal device comprising a cover member having an array of auxiliary control keys which overlie and engage associated control keys on the keyboard of the data terminal device. Sealing means are mounted in the edge of the cover member preventing liquids from entering the terminal keyboard. The auxiliary control keys are constructed to provide a sealing environment on the cover member. A shroud secured to the cover member contains any liquid spilled on the auxiliary keyboard. An opening in the shroud drains the liquid from the shroud and away from the auxiliary keyboard. Means are provided to releasably secure the cover member to the terminal keyboard to allow the interchanging of auxiliary keyboards to meet changing business conditions.

19 Claims, 3 Drawing Figures

AUXILIARY KEYBOARD APPARATUS

BACKGROUND OF THE INVENTION

The present invention is directed to data terminal devices in general and more particularly to the keyboard of the terminal devices. A business that has emerged in recent years is the fast food industry wherein the employees both manufacture and sell the product. The working environment in which this business is usually carried out includes the passage of food over a counter to a customer. The data terminal device which is used as part of the business transaction is normally positioned on the counter. Accidental spillage of drinks and food on the keyboard of the terminal device are regular occurences in this type of business environment. In addition, menu changes occur from day to day and in some instances during the same day requiring that the captions on the keys of the keyboard be changed. This latter problem has been solved in the prior art by providing a flexible member which is positioned over the control keys of an accounting machine, the flexible member containing indicia bearing areas which are located substantially identical with the control keys of the accounting machine to change the classification of the control keys. This arrangement is shown in U.S. Pat. No. 2,625,330 issued to K. M. Buckey et al. and assigned to the assignee of the present application. Such type of structure has been found not to work well on those keyboards where the keys are mounted in close proximity to each other, since depression of a portion of the flexible member will normally result in more than one control key being depressed. In view of the above problems, the principal object of the present invention is to provide a keyboard member which will prevent liquids from entering the keyboard of a terminal device and would be adaptable for changing the key classification indicia on the keyboard. Another object of this invention is to provide an auxiliary keyboard wherein the keys of the keyboard are constructed to be slidably mounted in the keyboard but incapable of falling out of the keyboard when the keyboard is in an inverted position. It is a further object of this invention to provide an auxiliary keyboard which is lightweight and low in cost.

SUMMARY OF THE INVENTION

In order to fulfill these objects, there is provided an auxiliary keyboard comprising a rigid support member having a depending edge portion for mounting the support member on a main keyboard. A sealing member is secured to the edge portion and engages the surface of the main keyboard for sealing the support member to the keyboard. The support member includes a plurality of apertures having a shoulder portion which slidably supports a keystem to which is mounted a key member. The top of the keystem has a circular guide portion which fits over the shoulder portion of the support member in a sealing relationship. A shroud member secured to the support member contains any liquid spilled on the auxiliary keyboard. The shroud member includes an opening which will drain the liquids spilled on the auxiliary keyboard away from the main keyboard. A plate member secured to the bottom of the keystem is positioned on an associated key of the main keyboard for actuation thereof upon depression of the auxiliary key member. The plate member acts as a stop preventing the key member and connected keystem from falling out of the support member when the support member is in an inverted position. Means are included for releasably securing the auxiliary keyboard to the main keyboard.

BRIEF DESCRIPTION OF THE DRAWING

Additional advantages and features of the present invention will become apparent and fully understood from a reading of the following description taken together with the annexed drawing.

DESCRIPTION OF THE PREFERRED EMBODIMENT

Figure 2:
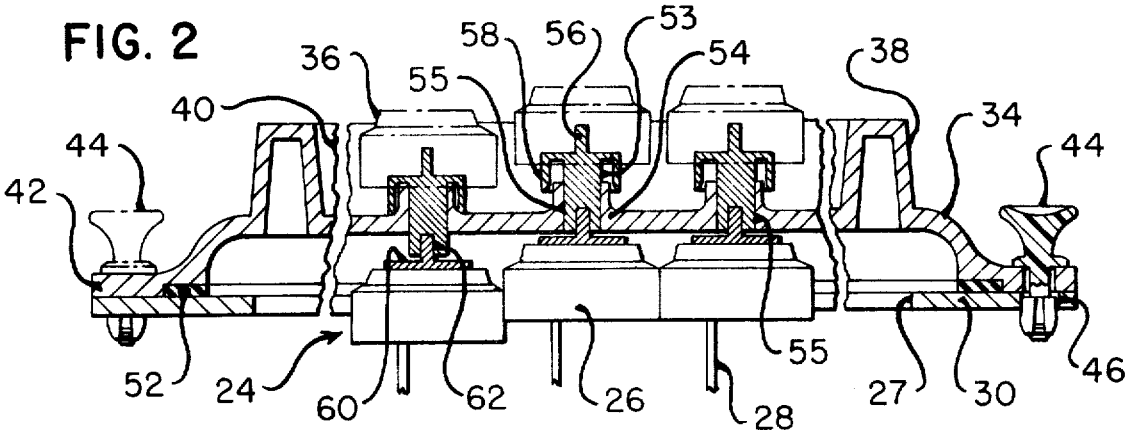
FIG. 2 is a partial cross-sectional view of the auxiliary keyboard and the main keyboard taken on lines 2—2 of FIG. 1 showing details of construction of the auxiliary keyboard and the means for mounting the auxiliary keyboard to the main keyboard.
Figure 3:
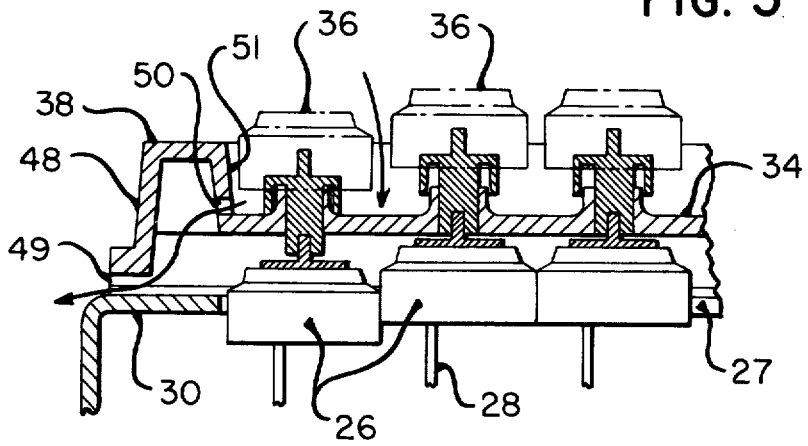
FIG. 3 is a partial cross-sectional view of the auxiliary keyboard taken on lines 3—3 of FIG. 1 showing the opening in the shroud and the direction of flow of liquids on the auxiliary keyboard.

Referring now to the drawing, there is shown a portion of a data terminal device 20 which includes a display panel 22 wherein information pertinent to the operation of the terminal is displayed. Included in the terminal device 20 is a keyboard generally indicated by the numeral 24 (FIG. 2) which includes an array of control keys 26, each secured to a keystem 28 which extends within the keyboard portion of the terminal device, the control key 26 in each instance being mounted for movement in a manner well known in the art to introduce data into the terminal device. As illustrated in FIGS. 2 and 3, the control keys 26 extend through an aperture 27 located in a keyboard cover 30 which forms a portion of the terminal device 20. The control keys 26 utilized in the present embodiment fall into two general functional categories. Included is a ten key section wherein the depression of the keys will introduce numerical data into the terminal device. The remaining control keys are classification keys which relate to the type of item that is being sold together with its price. This latter type of control keys is capable of being pre-set to indicate a predetermined price, the price subject to being changed from day to day or at different times during the day because of business requirements. Examples of the classification titles that may be found on the key in the keyboard include "hamburger," "fish sandwich, " "grilled cheese" and "steak."

In accordance with the present invention, there is selectively positioned over the keyboard 24 of the terminal device 20, which keyboard 24 is inclined at a slight angle with the horizontal, an auxiliary keyboard generally indicated by the numeral 32 (FIG. 1) and which includes a base member 34 having a similar inclination as the keyboard 24, an array of control keys 36 slidably positioned within the base member 34 and a shroud 38 secured to the base member 34 and extending around the control keys 36 forming a cavity 40 (FIG. 2) for containing liquids spilled on the auxiliary keyboard 32. The auxiliary keyboard 32, including its operating elements, is preferably formed of a high impact plastic material such as styrene.

Figure 1:
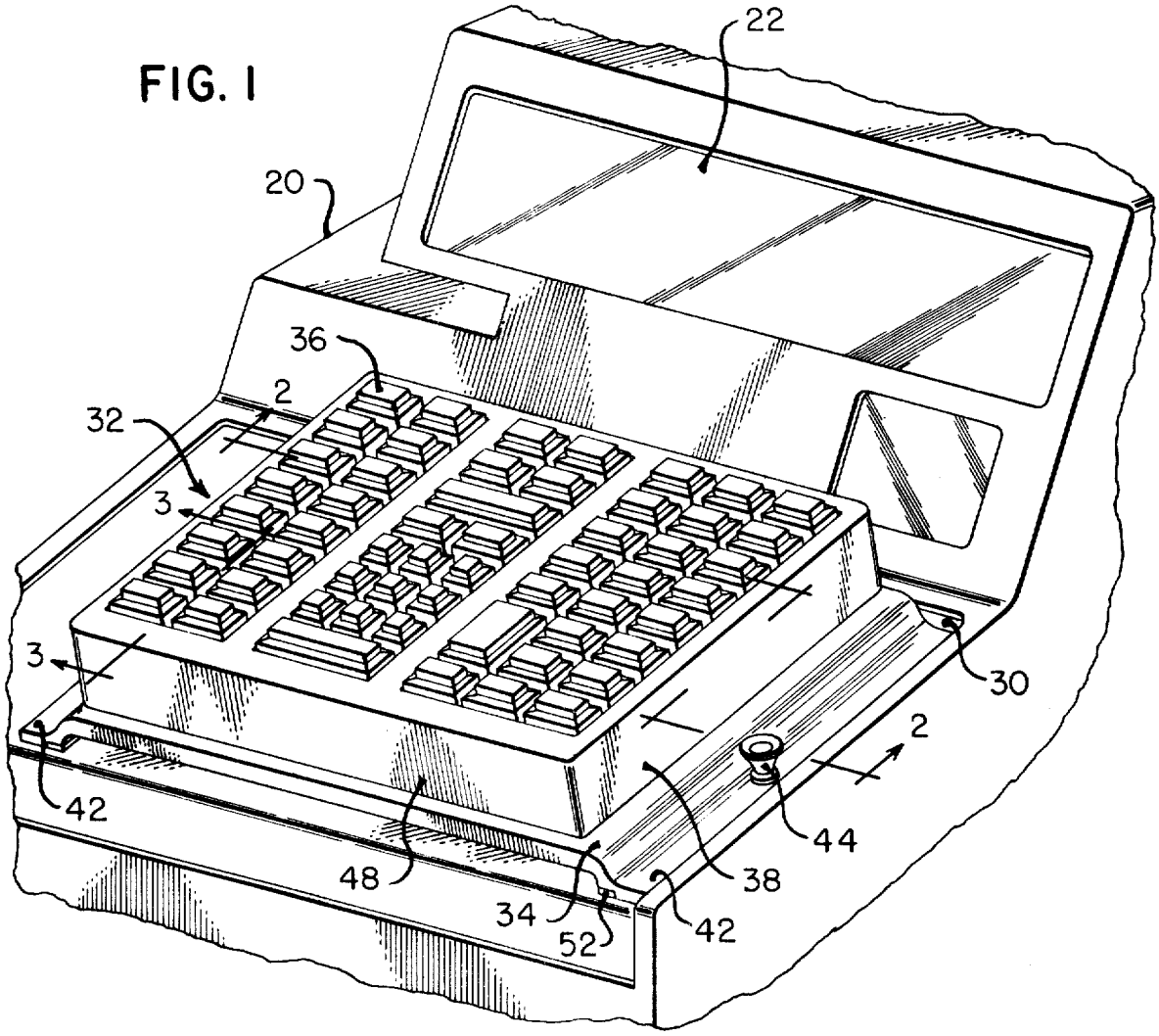
FIG. 1 is a perspective view of the auxiliary keyboard mounted to the main keyboard of a data terminal device.

As shown more clearly in FIG. 2 of the drawing, the base member 34 includes a pair of opposing dependent side flange portions 42 which support the base member 34 on the keyboard cover 30 of the terminal device and position the base member above the control keys 26 of the keyboard 24. Mounted within each flange portion 42 is a latch member 44 which, when inserted in an aligned aperture 46 located in the keyboard cover 30, will releasably secure and align the base member 34 to the keyboard cover 30. The latch member 44 illustrated in FIGS. 1 and 2 is of the type which when depressed by the operator will latch the base member 34 to the keyboard cover 30, the base member 34 being urged under pressure against the keyboard cover by the latching action of the member 44. By pulling up upon the latch member 44, the base member 34 is released for removal by the operator. It is obvious that other types of latch members can be employed to latch the base member 34 to the keyboard cover 30 in this manner.

As best seen in FIG. 3, the front edge 48 of the shroud 38 extends downwardly to form an opening 49 with the keyboard cover 30. Communicating with the opening 49 is an aperture 50 located in an inner wall portion 51 of the front edge of the shroud 38. As indicated by the arrows in FIG. 3, any liquid spilled or otherwise deposited on the base member 34 will flow towards the front edge 48 of the shroud 38 due to the inclination of the base member 34, in turn flowing through the aperture 50 to the keyboard cover 30 and then through the opening 49 to the outside of the terminal device 20. This arrangement will drain the liquid from the auxiliary keyboard without requiring the removal of the auxiliary keyboard 32.

If the keyboard 24 of the terminal device should be mounted at a zero inclination with a horizontal plane or if the business environment in which the terminal device is used will not allow the liquid to be drained adjacent the terminal device, the aperture 50 would not be employed and any liquid deposited on the base member 34 will require the auxiliary keyboard 32 to be removed from the keyboard 24 — the liquid removed therefrom and then the auxiliary keyboard 32 replaced. In this latter case, while not illustrated, the front edge of the shroud 38 will extend downwardly to engage the keyboard cover 30 in the same engaging manner as the flange portions 42 shown in FIGS. 1 and 2.

In order to seal the terminal keyboard 30 from liquids spilled on the terminal device 20, there is secured to the inner edge of the flange portion 42 of the base member 34 by any suitable manner a seal member 52 (FIG. 2) whose contact surface engages the top surface of the keyboard cover 30 in a sealing relationship when the auxiliary keyboard 32 is mounted on the keyboard cover 30. The seal member 52 is preferably composed of rubber or other type of elastic material which can perform as an effective sealing member, the seal member 52 being normally urged against the cover 30 by the latching action of the latch member 44 and thereby increasing the sealing action thereof. Depending on the construction of the auxiliary keyboard 32 as described previously, the seal member 52 may be mounted in the edges of the auxiliary keyboard 32 to form a continuous seal around the keyboard 32 or in the case of the shroud 38 containing the opening 49, the seal member 52 may be mounted in the side and rear edges of the auxiliary keyboard 32. Thus it is obvious that in view of such seal member 52 any liquids spilled on the keyboard cover 30 will be prevented from entering the apertures 27 in the keyboard cover 30 and the interior of the data terminal device.

As understood from FIG. 2, each of the auxiliary control key members 36 of the auxiliary keyboard 32 is mounted on a keystem 53 which in turn is slidably positioned within an aperture 55 located in a shoulder portion 54 of the base member 34, each control key member 36 being press fitted over a stem portion 56 of the keystem 53. The keystem 53 also includes a downwardly extending circular guide portion 58 which slidably engages the outside surface of the shoulder portion 54 of the base member 34. Associated with each of the auxiliary control key members 36 is a flat plate member 60 secured to the bottom of the keystem 53 by press fitting a stem portion 62 of the plate member 60 within the keystem 53. The plate member 60 normally rests on top of an associated control key 26 in the terminal keyboard 24. It will be obvious from this arrangement that depression of the auxiliary control key member 36 will result in the depression of its associated control key 26. This condition is illustrated in FIGS. 2 and 3 where the leftmost control key 36 is shown in a depressed position.

As best seen in FIG. 2, the lower edge of the circular guide portion 58 of the keystem 53 normally extends to a position below the top edge of the shoulder portion 54 when the control key members are in the home or non-depressed position thereby forming a sealing relationship which prevents liquids spilled on the auxiliary keyboard 32 from entering the terminal keyboard aperture 27 through the aperture 55 in the shoulder portion 54. Upon depression of the auxiliary control key member 36, the guide portion 58 of the keystem 53 will move downward along the outer edge of the shoulder portion 54 until it engages the base member 34, thereby limiting the downward movement of the control key 36. Upon release of the auxiliary control key member 36, the control key 26 of the terminal keyboard 24 will be returned to its home position by a return mechanism (not shown) located within the terminal device 20 in a manner well known in the art.

The guide portion 58 of the keystem 53 together with the plate member 60 cooperate to slidably secure the keystem 53 to the base member 34. As shown in FIG. 2, the plate member 60 is formed with a diameter which is greater than the aperture 55 in the shoulder portion 54 thereby preventing the auxiliary control keys 36 from falling out of the base member 34 when the auxiliary keyboard 32 is placed in an inverted position. The plate member 60 further locates the lower edge of the guide portion 58 of the keystem 53 with respect to the top edge of the shoulder portion 54 thereby controlling the sealing effect of the guide portion 58. Thus, it is obvious that the greater the overlap of the guide portion 58 with the top of the shoulder portion 54, the greater the sealing action of this arrangement.

From the auxiliary keyboard construction shown and described herein, it is obvious that any spillage of liquids either on the terminal keyboard 24 or on the auxiliary keyboard 32 will not interfere with the working operation of the terminal 20. By constructing several auxiliary keyboards 32 each having the control key members 36 capped with different classification indicia, various operating changes can be made to the keyboard 24 of the terminal by merely interchanging auxiliary keyboards which reflect the required key indicia for the business conditions in which the terminal is to serve. Depending on the construction of the auxiliary keyboard, any liquid contained within the shroud 38 around the auxiliary control keys 36 will either be automatically drained from the auxiliary keyboard or such auxiliary keyboard can be easily removed from the terminal, the liquid removed, and then such keyboard replaced over the terminal keyboard with very little time lost in the operation of the terminal.

While the principals of the invention have now been made clear in an illustrated embodiment, it will be obvious to those skilled in the art that many modifications of structure, arrangements, elements and components can be made which are particularly adapted for specific environments without departing from those principals. The appended claims are therefore intended to cover and embrace any such modifications within the limits only of the true spirit and scope of the invention.

What is claimed is:

1. An auxiliary keyboard apparatus adapted for mounting on a business machine keyboard having key members therein, the auxiliary keyboard apparatus comprising a. means for slidably supporting a plurality of key means on the keyboard wherein the key means are operatively associated with the key members for actuation thereof;

b. and means carried by said supporting means and engaging the keyboard when mounted thereon for sealing the key members from any liquids however deposited on said keyboard.

2. The auxiliary keyboard apparatus of claim 1 wherein said supporting means includes a. support portions each having an opening therein;

b. said apparatus including means for slidably positioning the key means within each of said openings;

c. and second means secured to said key means and operatively associated with said support portions for sealing the opening in the support portions of the supporting means from liquids deposited on the supporting means.

3. The auxiliary keyboard of claim 1 including means operatively associated with said supporting means for channeling liquids deposited on said supporting means through a predetermined path away from said supporting means.

4. The auxiliary keyboard apparatus of claim 1 wherein said key means includes means for limiting the movement of the key means in opposite directions within the supporting means wherein the key means are slidably secured to said supporting means.

5. The auxiliary keyboard of claim 1 wherein a. said supporting means includes depending portions having a surface engaging the keyboard in a supporting relationship when mounted thereon, and b. said sealing means comprises a sealing member secured to the surface of the depending portion and engaging the keyboard to seal the interior of the supporting means from liquids deposited on the keyboard.

6. In combination with a keyboard having key members therein, an auxiliary keyboard adapted for mounting on the keyboard comprising a. support means having defined portions for supporting the support means on the keyboard;

b. first means associated with said defined portions for sealing the key members in the keyboard from liquids however deposited on the keyboard;

c. auxiliary key members mounted in said support means for movement to a position engaging the key members in the keyboard;

d. second means secured to said auxiliary key members for sealing the key members in the keyboard from liquid however deposited on the support means;

e. and means operatively associated with said support means for releasably securing the support means to the keyboard.

7. The auxiliary keyboard of claim 6 including means secured to said support means and surrounding said auxiliary key members for channeling liquids deposited on said support means away from said support means.

8. The auxiliary keyboard of claim 6 in which a. said support means comprises a rigid base member having depending flange portions engaging the keyboard to support the base member on the keyboard, and b. said first sealing means comprises a sealing member secured to said flange portion and engaging the keyboard to seal the key members of the keyboard from liquid deposited on the keyboard.

9. The auxiliary keyboard of claim 6 in which said second sealing means includes a. overhang means secured to the top of the auxiliary key members for limiting the movement of the auxiliary key members in the support means in a first direction;

b. and the auxiliary keyboard includes blocking means secured to the bottom of the auxiliary key members for limiting the movement of the auxiliary key members in the support means in a direction opposite to said first direction wherein the auxiliary key members are slidably held in said support means.

10. The auxiliary keyboard of claim 7 in which said channeling means comprises a. a wall member extending around the support means forming a compartment thereon for retaining liquids deposited on said support means;

b. and an aperture in said wall member to channel liquids from said compartment to a position away from said support means.

11. The auxiliary keyboard of claim 8 in which said base member includes a. a plurality of apertures extending through the base member;

b. a shoulder portion adjacent each of the apertures for positioning an auxiliary key member within said aperture; and c. said second sealing means includes overhang means secured to the auxiliary key member and overlying said shoulder portion to prevent liquids deposited on said base member from entering the key member through said apertures.

12. In combination with a data input device having a keyboard including a plurality of control key members for controlling the operation of the terminal device, an auxiliary keyboard comprising a. a rigid support member having defined surfaces for supporting the support member on the keyboard of the terminal device;

b. first sealing means engaging said supporting surfaces and the keyboard when the support member is positioned on said keyboard to prevent liquids however deposited on the keyboard from engaging the control key members;

c. a plurality of auxiliary key members slidably mounted in said support member and adapted to be positioned adjacent the control key members for actuation thereof upon operation of said auxiliary key members;

d. second sealing means carried by said auxiliary key members to prevent liquid however deposited on said support member from engaging the control key members;

e. and means for releasably securing the support member to the keyboard of the input device.

13. The auxiliary keyboard of claim 12 including a wall member secured to said support member and surrounding said auxiliary key members for containing liquids introduced on said support member.

14. The auxiliary keyboard of claim 13 in which said wall member includes an opening for directing liquid contained by said wall member away from said auxiliary keyboard.

15. The auxiliary keyboard of claim 12 in which said first sealing means comprises an elastic member which is compressed by said securing means when securing the support member to the keyboard to seal the control key members from liquids deposited on the data input device keyboard.

16. The auxiliary keyboard of claim 12 in which a. said support member comprises a base member having depending flange portions for supporting the base member on the terminal keyboard, said base member including a plurality of shoulder portions containing an aperture within which is positioned one of said auxiliary key members for movement therein; and b. said second sealing means includes a depending overhang portion of the auxiliary key member overhanging the shoulder portion and extending below the top of the shoulder portion to prevent liquids deposited on the base member from entering the aperture in the shoulder portion.

17. The auxiliary keyboard of claim 16 which includes a plate member secured to the bottom of the auxiliary key member and engaging an associated control key member to actuate the control key member upon operation of the auxiliary key member, said plate member being of a size greater than the aperture in said base member whereby the auxiliary key member is slidably retained in the aperture in said base member.

18. In combination with a keyboard of a data input device having an array of control key members located therein, an auxiliary keyboard apparatus adapted for positioning on said keyboard and over the control key members comprising a. rigid support member having defined surfaces for supporting the support member on the keyboard of the data terminal device, said support member including shoulder portions extending upwardly from the support member, each shoulder portion having an aperture therein extending through the support member;

b. an elastic member engaging said supporting surface and the keyboard upon the positioning of the support member on the keyboard to seal the control key members from liquids however deposited on the keyboard;

c. a plurality of auxiliary key members having data bearing indicia thereon each slidably positioned within an aperture in the shoulder portion of the support member and extending through the support member for engaging and actuating an associated control key member upon operation of such auxiliary key member, each of said auxiliary key members including an overhang portion adjacent and extending downwardly below the top edge of the shoulder portion to prevent liquids deposited on said support member from entering the aperture;

d. a shroud member secured to the top of said support member and extending around the auxiliary key members to contain and liquids however deposited on the support member;

e. means in said shroud member for draining liquids deposited on the support member away from said input device;

f. and means for releasably securing the support member to the keyboard of the input device whereby support members having auxiliary key members with different data bearing indicia may be interchangeably secured to the data input device.

19. The combination of claim 18 including a plate member secured to the bottom of each of said auxiliary key members and engaging an associated control key member for actuating said control key member upon operation of the auxiliary key member, said plate member and said overhang portion slidably retaining the auxiliary key member in the support member.

* * * * *